United States Patent [19]

Nelson

[11] Patent Number: 4,617,538

[45] Date of Patent: Oct. 14, 1986

[54] MICROWAVE WAVEGUIDE SWITCH ASSEMBLY

[76] Inventor: Victor H. Nelson, 10 Redwood Dr., Dix Hills, N.Y. 11746

[21] Appl. No.: 623,151

[22] Filed: Jun. 21, 1984

Related U.S. Application Data

[63] Continuation-in-part of Ser. No. 464,689, Feb. 7, 1983.

[51] Int. Cl.[4] ..... H01P 1/10; H01P 5/12

[52] U.S. Cl. ..... 333/106

[58] Field of Search ..... 333/101, 105, 106, 256, 333/258, 261, 262

[56] References Cited

U.S. PATENT DOCUMENTS

| | | | |
|---|---|---|---|
| 2,814,782 | 11/1957 | Zaleski | 333/106 |
| 2,999,213 | 9/1961 | Olivieri et al. | 333/106 |
| 4,242,652 | 12/1980 | Shishido et al. | 333/106 |

*Primary Examiner*—William L. Sikes
*Assistant Examiner*—Robert E. Wise
*Attorney, Agent, or Firm*—Loveman: Edward H.

[57] ABSTRACT

A microwave waveguide switch assembly comprises a stationary housing having four openings and a cylindrical chamber of housing rotor which has a microwave switch section formed with two cylindrical axially spaced plates at ends of an integral bar to contain the microwave energy between the walls of the rotor and the chamber wall during transmission of microwave energy through selected passages in the housing. The plates and the bar along with the chamber wall provide an essentially sealed microwave passageway thus minimizing transmission losses and at the same time, preventing leakage of microwave energy between passageways.

4 Claims, 15 Drawing Figures

MICROWAVE WAVEGUIDE SWITCH ASSEMBLY

This application is a contination-in-part of my prior copending application Ser. No. 464,689, filed Feb. 7, 1983.

This invention relates to the art of microwave waveguide switches, and more particularly concerns an improved motor driven microwave switch having reduced size and weight, but providing superior performance and reliability than prior microwave waveguide switches.

Typical waveguide switches have solid circular rotors with semi-circular internal passages for microwave transmission in 90° increments. This type of rotor construction contains the following disadvantages:

(1) The size of the rotor is inherently of large diameter, with a higher inertia which requires a larger housing and a larger motor to drive the rotor between positions. More electrical energy will be needed and the speed of switching will be impacted. Weight and size are obviously effected by this larger rotor.

(2) Typically, microwave energy is transmitted in hollow, rectangular metal conductors known as waveguides. Discontinuities in the walls such as airgaps or seams interrupt the flow of energy causing losses in energy and undesirable leakage. In the conventional solid circular rotor, microwave energy is transmitted from the stationary housing through a rectangular airgap into the rotor. The energy exits the rotor through a second rectangular airgap into the housing. Energy losses and leakages occur within the airgaps.

According to the invention, a microwave waveguide switch is provided with a greatly simplified rotor which permits a much smaller and lighter switch housing, having corner and side cutouts to further reduce the weight of the switch. Furthermore, in the invention a vertical wall within the rotor has been eliminated. The energy is transmitted through the rotor which consists of three sides only, and the fourth side is provided by the stationary housing chamber wall thereby eliminating the two vertical gaps typical of the conventional rotor. Losses and leakages associated with these airgaps have been eliminated, improving the performance of the switch. The small rotor provides a reduced path length also resulting in less insertion losses.

Some prior art waveguide switches have had a rotor consisting of only the rectangular plate, but since the plate must rotate within the chamber, the airgaps at the top and bottom produce discontinuities in the vertical wall, resulting in losses and leakages of energy between passages.

This invention describes a waveguide switch which is suitable for all microwave bands and whose design will provide superior transmission properties over a limited band or the full band of microwave frequencies at a substantial savings in weight, size, inherent heating, cost, drive-motor prime power. All of these improved properties are vital for such applications as satellites where requirements for 50 or more motor driven waveguide switches per satellite are common. When the switch operates to transmit microwaves at right angles; microwave propagation within the switch is between the rotor and the walls of a chamber in the switch housing wherein the rotor rotates. In this version of the microwave switch, the rotor assumes either of two positions, 90° apart to act like a double pole, double throw switch, or a single pole, double throw switch. In another version the rotor assembes either of three positions to act as a triple throw.

It is therefore a principal object of the present invention to optimize the switching and transmission performance of a microwave waveguide switch by means of a switch construction having reduced size and weight and thereby requiring a smaller and lighter motor than prior art microwave waveguide switches.

It is still another object of the present invention to provide a microwave switch of the type described wherein microwave propagation within the switch is between the switch rotor and the chamber walls in which the rotor rotates.

It is another object of the present invention to provide a microwave waveguide switch of the type described having a lightweight small diameter rotor housed in a small lightweight housing requiring a small drive motor.

It is yet another object of the present invention to provide a microwave waveguide switch of the type described which has a lightweight rotor which will switch faster, is easier to fabricate and is more reliable.

These and other objects and many of the attendant advantages of this invention will be readily appreciated as the same becomes better understood by reference to the following detailed description when considered in connection with the accompanying drawings in which.

Figure 9:
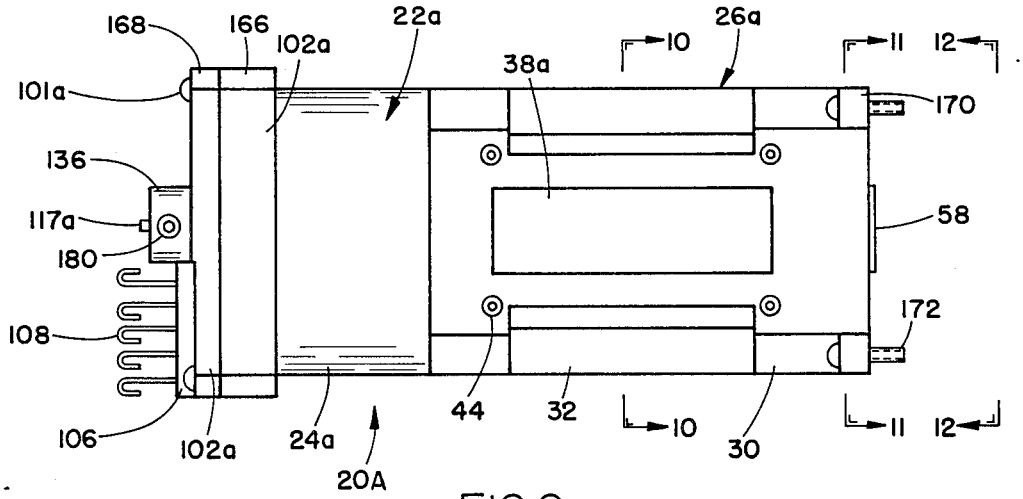
FIG. 9 is a side elevational view similar to FIG. 1 of another microwave switch-motor assembly embodying another version of the invention.
Figure 10:
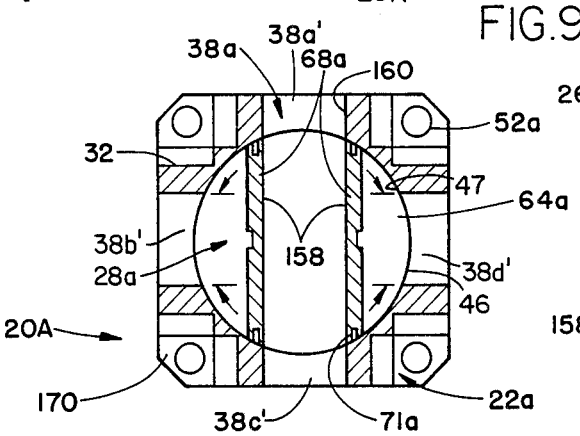
Figure 11:
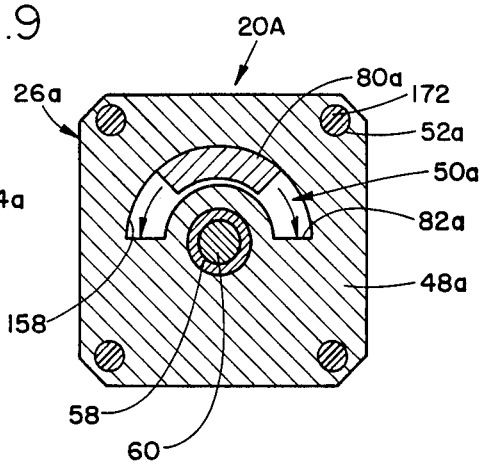
Figure 12:
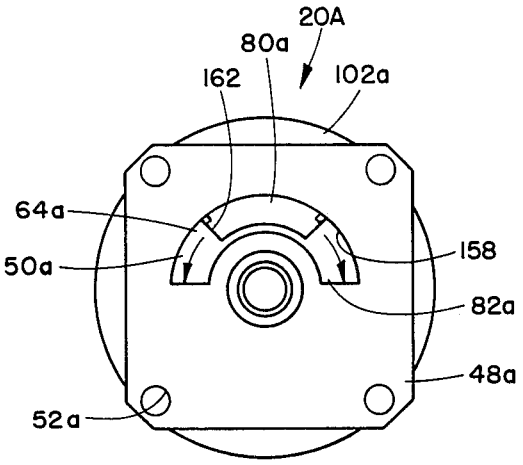

FIGS. 10 and 11 are cross sectional views taken along lines 10—10 and 11—11 of FIG. 9;

FIG. 12 is an end elevational view taken along line 12—12 of FIG. 9.

Figure 13:
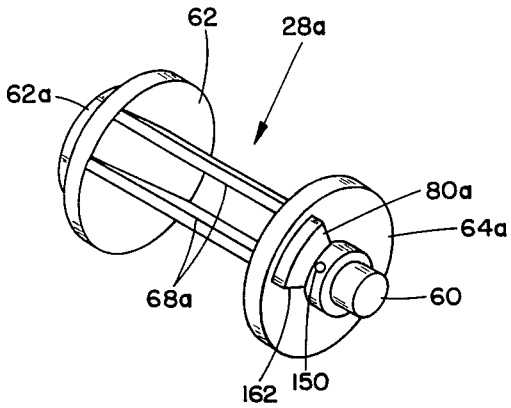
Figure 14:
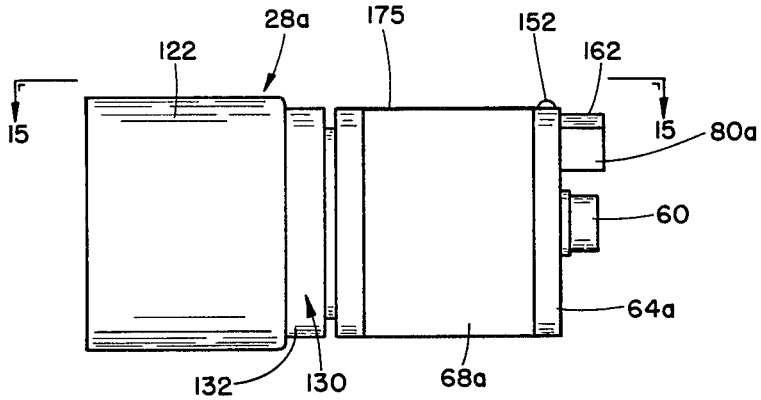

FIG. 13 is a reduced perspective view of the switch portion of the rotor employed in the assembly of FIGS. 9–12;

FIG. 14 is a side elevational view of the rotor of FIG. 13; and

Figure 15:
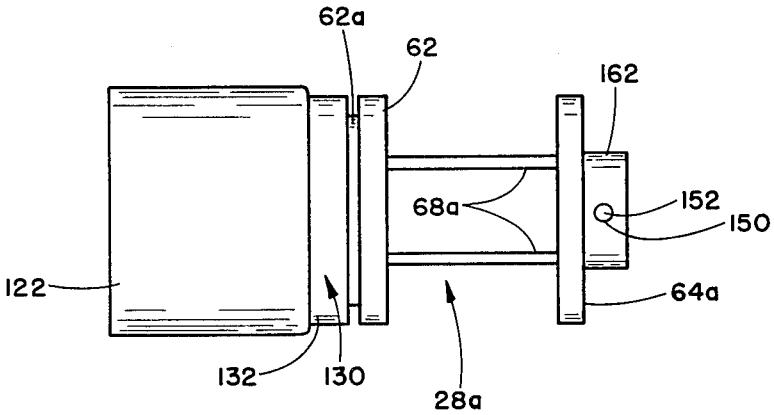

FIG. 15 is a plan view of the rotor taken along the line 15—15 of FIG. 14.

Figure 1:
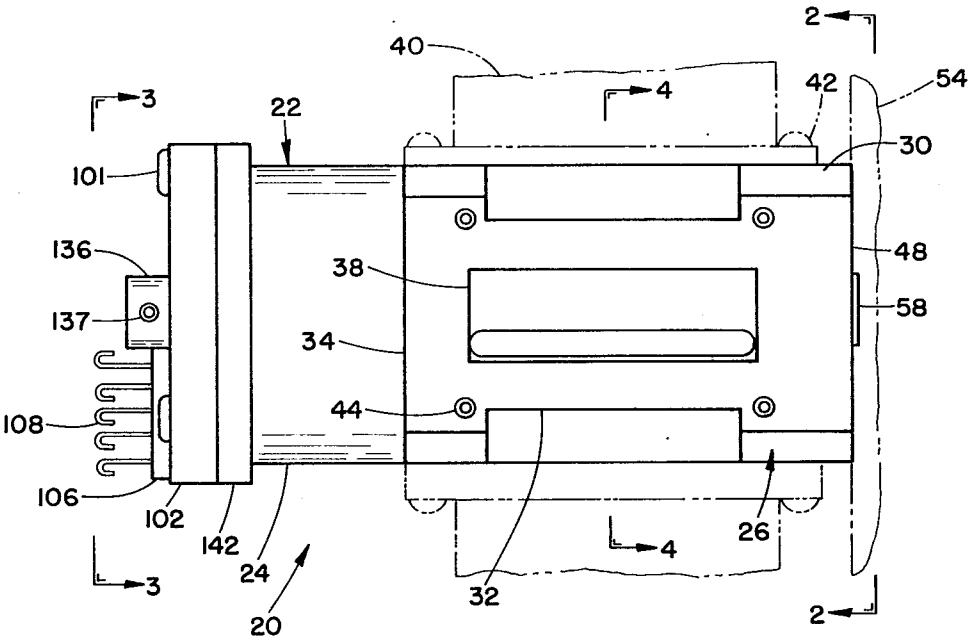
FIG. 1 is a side elevational view of a microwave switch-motor assembly embodying the invention.
Figure 2:
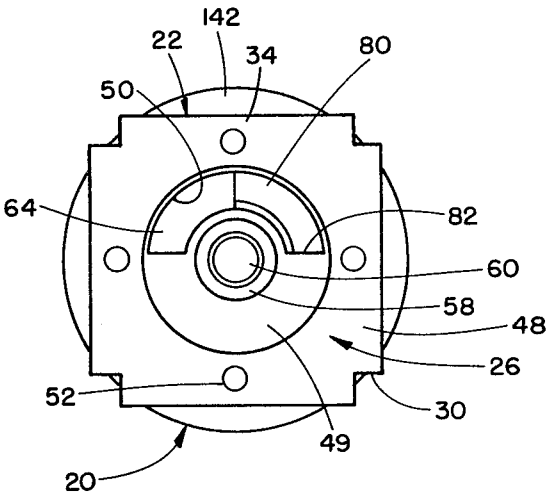
FIG. 2 is an end elevational view taken along line 2—2 of FIG. 1.
Figure 3:
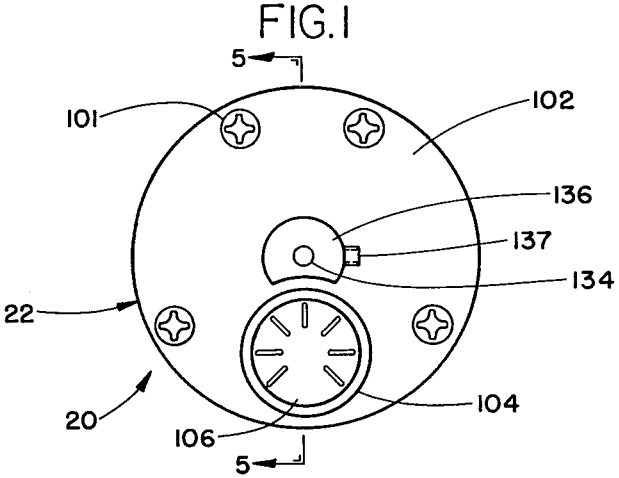
FIG. 3 is an end elevational view taken along line 3—3 of FIG. 1.
Figure 4:
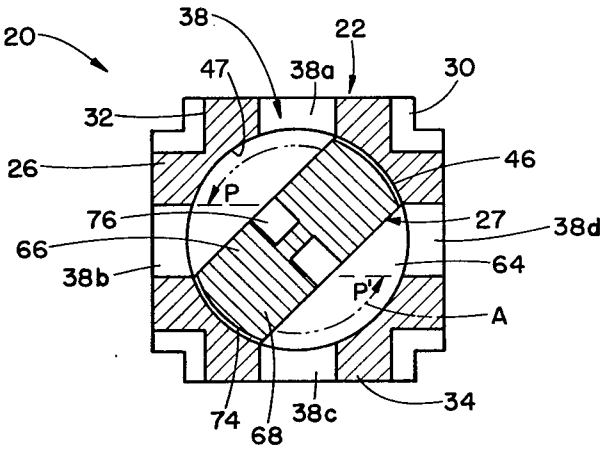
FIG. 4 is a cross sectional view taken along line 4—4 of FIG. 1.
Figure 5:
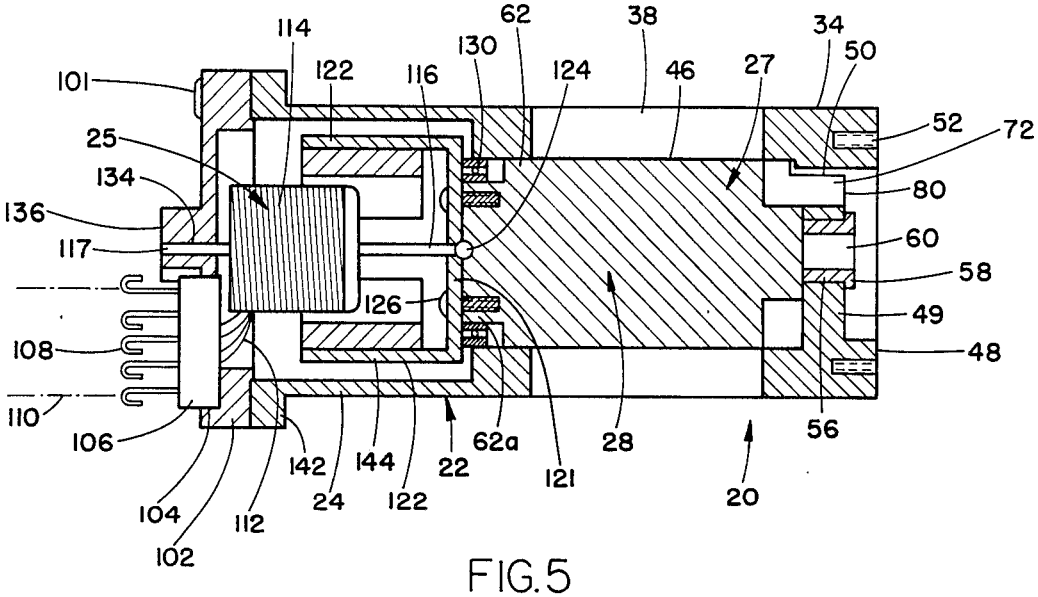
FIG. 5 is longitudinal, central sectional view taken along line 5—5 of FIG. 3.
Figure 6:
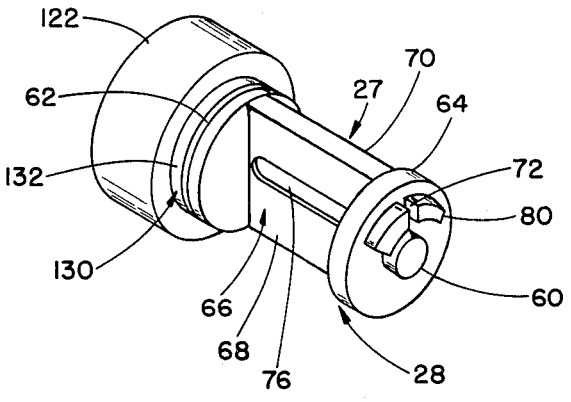
FIG. 6 is a reduced perspective view of the rotor of the assembly of FIGS. 1–5.

Referring now to the drawings wherein like reference characters desigate like or corresponding parts throughout there is illustrated in FIGS. 1–5 a microwave switch-motor assembly generally designated as reference numeral 20 and having a housing 22 made of lightweight metal such as aluminum 24 which houses a motor 25 of the switch assembly 20. The housing 22 has a generally rectangular end portion 26 which contains a switch portion 27 of a rotor 28 of the switch assembly 20, as best shown in FIGS. 6–8.

End portion 26 of the housing 22 has rectangular and corner cutouts 30, and central corner cutouts 32, which reduce the weight of the assembly. The housing portion 26 has four flat sides 34 each provided with a rectangular opening 38 affording a direct passage for microwave energy between the hollow interior of the housing 22 and one of four waveguides 40 (shown in dotted lines in FIG. 1) attachable by screws 42 engaged in screw holes 44 at corners of the flat sides 34 of the housing portion 26. The hollow housing portion 26 is formed with a cylindrical inside chamber 46, having a wall 47 at which the rectangular openings 38 terminate. A flat end wall 48 of the housing portion 26 has a recessed circular portion 49 which is formed with an arcuate 180° opening 50 communicating with the chamber 46. Threaded holes 52 in the wall 48 (see FIG. 2) receive screws for mounting the assembly 20 on a suitable support 54 indicated by dotted lines in FIG. 1. A central opening 56 in the recessed wall portion 49 receives a cylindrical bearing 58 which journals a stub shaft 60 at the outer end of the rotor 28.

Figure 7:
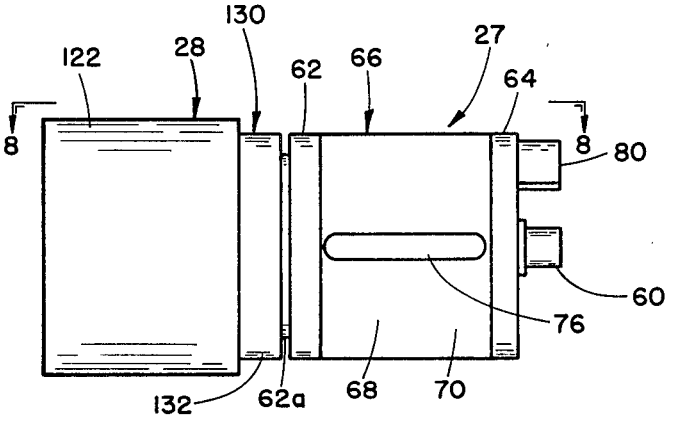
FIG. 7 is a side elevational view of the rotor.
Figure 8:
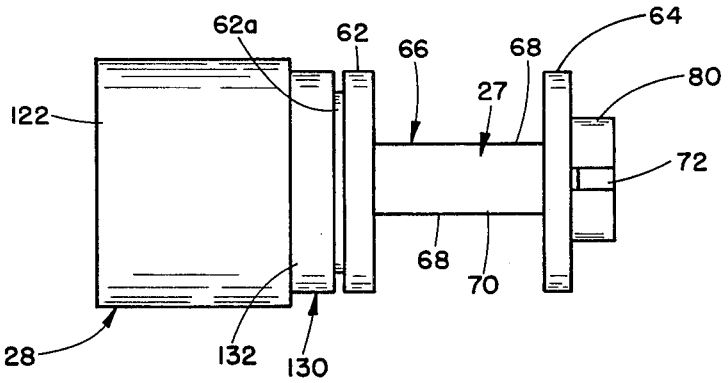
FIG. 8 is a plan view of the rotor taken along line 8—8 of FIG. 7.

The switch portion 27 of the rotor 28 has a pair of axially spaced cylindrical end plates 62, 64 (FIG. 7 and 8). Between the end plates 62, 64 and integral therewith is a flat central block 66, which has opposite flat parallel sides or walls 68. The thickness of the block 66 is equal to the circumferential spacing of the openings 38 at the chamber 46 to insure that walls of passages for microwaves between selected pairs of the openings 38 via the chamber 46 register with the sides of the openings 38. All the openings 38 are of equal length and width. The length of each wall 68 equals the length of each of the openings 38. The width of each wall 68 is equal to the diameter of each end plate 62, 64, which is precisely fitted to rotate inside the chamber walls 47. The diameter of the chamber 46 is thus substantially equal to that of the circular end plates 62, 64, and of the width of the walls 68 of the block 66. The cylindrical end plates 61, 64, and the block 66 provide continuity by eliminating gaps to reduce losses and prevent leakage of microwave energy beyond the end plates in the chamber 46 axially of the rotor 28 and the housing 22. The integral joining of the ends of the block 66 with the plates 62, 64, reduces losses and prevents leakage of microwave energy between passages in the chamber 46 separated by the block 66. Outer walls 74 of the block 66 as shown in FIG. 4 are convex to fit flush with the concave side walls of the chamber 46. Grooves 76 in opposite sides of the block 66 serve for fine tuning of the microswitch assembly 58 to pass a prescribed broad band of microwave frequencies. The reduction of gap losses and prevention of microwave leakage by the plates 62, 64, and the block 66 insures that faithful propagation of microwave frequencies through the rotor will be maintained. End plate 64 is formed with an axial projection 80 extending 90° circumferentially and rotatably disposed in the semicircular opening 50. Ends 82 of opening 50 in the recessed end wall portion 49 of the housing 22 serve as abutments or stops for the projection 80 to limit rotation of the rotor 28 to 90° in both clockwise and counterclockwise directions as viewed in FIG. 2.

A sector motor 25 may be employed to turn the rotor 28. This motor may be of conventional type such as described in U.S. Pat. No. 3,970,980 attached by screws 101 to the cylindrical end portion 24 of the housing 22 is a circular plate 102 provided with an opening 104 in which is fitted an insulated plug 106. Circuit terminals 108 are fitted in the plug 106 wires 110 indicated by dotted lines in FIG. 5 are connectable to the terminals 108 from an external circuit which applies power to operate the motor 25. Wires 112 inside the housing portion 24 are connected between the terminals 108 and a stationary armature 114 of the motor 25. The armature 114 has inside and outside axial stationary shafts 116, 117. The inside shaft 116 extends through an opening in end wall 121 of a cup shaped motor housing 122 and contacts a ballbearing 124 engaged in a recess in axial extension **62*a* of the plate 62. The motor housing 122 is attached to the switch portion of the rotor 28 by screws 126 engaged in holes in the plate or wall extension 62*a*. A ball bearing assembly 130 is disposed between the motor housing wall 122 and the plate 62. The outer bearing race 132 is held stationary at the inside wall of the chamber 46. The inner race is force fitted to the plate extension 62*a* and rotates with the rotor 28. The outer mounting shaft 117 of the armature 114 is secured in a bore 134 by set screw 137. The bore 134 is formed in axial projection 136 of the stationary end plate 102 which is secured by screws 101 to an annular flange 142 at the outer end of the cylindrical portion 24 of the housing 22. Secured inside the cylindrical, cup shaped motor housing 122 are arcuate permanent magnets 144 which rotate with the rotor 28 around the stationary armature 114**.

The assembly 20 operates as a double pole switch in the following manner. When the motor 25 is energized by current of one polarity the rotor 28 rotates in one direction, for example, clockwise, to the position shown in FIG. 4. Here the arcuate rotor projection 80 will abut and rotation will be stopped by the right end 82 of the 180° arcuate opening 50 in the wall 48; see FIG. 2. There will now be two passages P and P′ through the microwave switch, between the switch portion 27 of the rotor 28 and the chamber wall 47 as indicated in FIG. 4. Passage P extends between the upper opening **38*a*, the chamber wall 47 and the side opening 38*b*. Passage P′ extends between the bottom opening 38C and the side opening 38*d*. If the direction of current flow is reversed in the armature 114, the rotor 28 will turn counterclockwise as indicated by arrow A in FIG. 4. This will reverse the passages so that microwave energy passes through one passage between the upper opening 38*a* and the side opening 38*d* via the chamber wall 47, and through another passage between the bottom opening 38*c* and the side opening 38*b* via the chamber wall 47**.

A triple position microwave switch motor assembly 20A is shown in FIGS. 9–12. The assembly 20A is similar to the assembly 20 of FIGS. 1–8 and corresponding parts are identically numbered.

A rotor **28*a* shown in FIGS. 10, 13, 14, and 15 has a pair of thin, narrow, flat, parallel plate portions 68*a*. Inner adjacent sides 158 are spaced apart a distance equal to the width of each rectangular opening in the chamber 46. Outer sides of the plate portions 68*a* are spaced apart a distance equal to the circumferential spacing of the openings 38′ in the chamber 46. By this arrangement, it is insured that walls of all passages through the chamber 46 register with sides of the openings 38 in the chamber 46 in the two extreme and central positions of the rotor in the housing. A 90° axial, arcuate projection 80*a* of a circular end wall 64*a* moves in an arcuate 180° opening 50*a* in an end wall 48*a* of a housing 22*a***.

When the rotor **28*a* is turned clockwise 45° to the right from the central the position shown in FIGS. 10 and 12, the rotor 28*a* will have a position similar to that shown in FIG. 4. Then the microwaves may flow in one passage between the openings 38***a*′ and 38*b*′, and may flow in another passage between the openings 38*c*′ and 38*d*′. When the rotor 28*a* is turned counterclockwise 45° to the left from the central position shown in FIG. 10, the rotor 28*a* will have a position rotated 90° from that shown in FIG. 4. Then microwaves may pass in one passage between the openings 38*a*′ and 38*d*′, and may pass in another passage between the openings 38*c*′ and 38*b*′. The sector motor in housing 132 will reverse the position of the rotor in response to the polarity of current applied to the motor armature 114 as described above in connection with the assembly 20.

The structure of the housing 22*a* is slightly modified from that of the housing 22 in the assembly 20. Here an end wall 102*a* of a housing portion 24*a* is reduced in mass by removing material between corners leaving four corner ears 166 which register with ears 168 provided on an end plate 102*a* that carries the motor armature 114 as shown in FIG. 5. Screws 180 engages a shaft 117*a* of the armature 114, see FIG. 9.

The switch porition 26*a* of the housing 24*a* is modified by removal of material at the corners of the housing 24*a* to define four ears 170 which have holes 52*a* to receive screws 172 for mounting the assembly on a support.

It will be clear from the above that assembly 20*a* serves as a three position switch. There is a straight passage between the openings 38*a*′ and 38*c*′ when the rotor is in the central position, shown in FIG. 10. When the rotor is turned 45° in either direction the passages P and P′ in FIG. 4. The rotor turns a maximum of 90°.

Longitudinal slots 71*a* are also formed at ends of the wall edges and are used for tuning the switch, and matchin impedances to connecting waveguides. They also reduce coupling between paths or passages through the switch.

My aforedescribed new and novel rotor design is smaller in diameter, lighter in weight and a consequently enclosed in a smaller housing and is driven by a smaller drive motor which requires less power then prior art waveguide switches. Moreover, my new rotor is easier to fabricate (straight lines) and is more reliable and can handle microwave power energy more efficiently since self heating effects due to insertion loss are reduced. That is the thermal expansion of my rotor, being smaller in diameter is less than one of a larger diameter; and therefore, less prone to expand to where it seizes in the housing chamber. The rotor construction insures that there will be no gap losses or undesired leakage of microwave energy out of the housing chamber axially beyond the cylindrical end plates, and no leakage of microwave energy between passages in the chamber separated by the block integral with the end plates.

It should be understood that the foregoing relates to only a limited number of preferred embodiments of the invention which have been by way of example only, and that it is intended to cover all changes and modifications of the examples of the invention herein chosen for the purpose of the disclosure which do not constitute departures from the spirit and scope of the invention.

What is claimed is:

1. A microwave waveguide switch assembly operable in at least two positions, comprising:

a hollow housing having a cylindrical hollow chamber therein;

a rotor axially rotatable in said chamber;

said housing having four sides disposed at right angles to each other, with a rectangular opening in each of said sides communicating with said chamber for passing microwaves therethrough;

each of said openings having the same length and width and each of said openings being equally spaced circumferentially of said chamber;

said rotor having a pair of axially spaced cylindrical end plates integrally formed with a wall means thereinbetween extending axially of said chamber, said end plates extending perpendicular to the axis of rotation of said rotor to open two separate passages for passing microwaves through said housing between adjacent pairs of said openings, each of said separate passages being formed by said cylindrical end plates and said wall means of said rotor and by said walls of said chamber when said rotor is disposed in one of two positions, and two other separate passages for passing microwaves through said housing between two other adjacent pairs of said openings each of said other separate passages being formed by said cylindrical end plates and said wall means of said rotor and said walls of said chamber when said rotor is disposed in the other one of said two positions; the diameters of said end plates and width of said wall means being substantially equal to the diameter of said chamber to prevent leakage of microwaves out of said chamber beyond said end plates axially of said housing and rotor, and to prevent leakage of microwaves between said passages in said housing in each of said positions of said rotor, and to provide a rotor path presenting less discontinuities to the propagation of microwaves.

2. An assembly as defined in claim 1, wherein said rotor has further wall means to form a further passage for passing microwave through said chamber between a further pair of said openings when said rotor is disposed in a third position midway between said two positions.

3. An assembly as defined in claim 1 wherein said wall means of said rotor comprises two flat, parallel plate portions between said end plates and having inner adjacent sides spaced apart a distance substantially equal to the width of said openings so that walls of said passages in said chamber register with sides of said openings in said housing in each of said positions of said rotor in said housing.

4. An assembly as defined in claim 1, wherein said housing has an end wall formed with an arcuate 180° aperture; and an arcuate projection on said rotor extending axially into said aperture and subtending 90° circumferentially of said rotor to limit said rotor to 90° rotation in said housing between said two positions.

* * * * *